United States Patent [19]

Attar

[11] Patent Number: 4,834,335

[45] Date of Patent: May 30, 1989

[54] TREE STAND

[76] Inventor: Jose Attar, 1808 Robert St., New Orleans, La. 70115

[21] Appl. No.: 98,878

[22] Filed: Sep. 21, 1987

[51] Int. Cl.[4] ..... F16M 13/00

[52] U.S. Cl. ..... 248/526; 47/40.5; 248/527

[58] Field of Search ..... 248/526, 525, 524, 523, 248/527, 519; 47/40.5

[56] References Cited

U.S. PATENT DOCUMENTS

| | | | |
|---|---|---|---|
| 583,755 | 6/1897 | Kelly | 248/526 |
| 1,590,214 | 6/1926 | Waidelich | 248/526 |
| 1,642,231 | 9/1927 | Dover | 47/40.5 |
| 1,874,119 | 8/1932 | Propst | 248/526 X |
| 2,028,129 | 1/1936 | Allerton | 248/526 X |
| 2,437,494 | 3/1948 | Anderson | 248/526 X |
| 2,815,908 | 12/1957 | Scanland | 47/40.5 |
| 2,875,968 | 3/1959 | Ekola | 248/524 X |
| 3,307,813 | 3/1967 | Pleiss | 248/527 X |
| 4,007,901 | 2/1977 | Mancini et al. | 248/526 |
| 4,676,471 | 6/1987 | Moore | 248/526 |

*Primary Examiner*—Ramon O. Ramirez

*Attorney, Agent, or Firm*—Thomas R. Vigil

[57] ABSTRACT

A tree stand for holding a tree, such as a Christmas tree, in an upright position comprises a ring, a container having an open top, a closed bottom, a diameter which is less than the diameter of the ring and hook formations at the top of the container for engaging the ring so that the container depends from the ring. A plurality of legs is provided. Each leg has an upper section and a partially circular upwardly facing notch for engaging and supporting the ring in such a manner that the upper section of each leg pivots inwardly against a trunk of a tree when a cut lower end edge of the trunk of the tree is placed within the container and creates a downward force by virtue of the weight of the tree upon the bottom of the container.

14 Claims, 2 Drawing Sheets

TREE STAND

BACKGROUND OF THE INVENTION

1. Field of the Invention

The present invention relates to a tree stand which is utilized to support a tree in an upright position. The stand accepts a lower section of the tree trunk within its components to maintain the tree in an upright position. The tree stand is particularly adapted for use with a Christmas tree.

2. Description of the Prior Art

Heretofore various prior art tree stands have been proposed for use in maintaining a tree, such as a Christmas tree, in an upright position.

A well known prior art tree stand comprises a saucer-like member to which are connected four crescent like equidistantly spaced legs joined to the periphery of the saucer-like member. Upper ends of the legs are connected to one another by a ring having a diameter which is substantially greater than the diameter of a typical Christmas tree trunk.

Four set-screw elements are disposed equidistantly along the periphery of the ring, at positions central to the positions at which the legs are attached. Once a tree trunk has been positioned within the ring in such a manner that the lower cut end of the trunk will sit centrally within the saucer-like member, the set-screw elements are rotated to force sharp tips of the set-screw elements into the trunk of the tree and set the tree in an upright position within the stand.

Other examples of previously proposed tree stands can be found in the following U.S. Pat. Nos.:

| U.S. Pat. No. | Patentee |
|---|---|
| 583,755 | Kelly |
| 2,028,129 | Allerton |
| 2,437,494 | Anderson |

The Kelly U.S. Pat. No. 583,755 discloses a Christmas tree holder comprising three legs which are held together by a ring. The ring is received through a hole in each one of the three legs. The inner ends of the legs are concaved, having points at each end thereof which are adapted to engage the surface of the tree trunk. The trunk is inserted between the upper points and will drop down into engagement with the lower portion of the ends of the legs and the weight of the trunk will cause the upper points to be forced into the material of the tree trunk, thus holding the tree trunk securely.

The Allerton U.S. Pat. No. 2,028,129 discloses a holder for Christmas trees or other objects. The holder comprises a cup which has handles. The handles include a cylindrical bar which is received through a slit into a cylindrical notch in one of three legs of the holder. Three handles with three bars are provided for interconnecting with the three legs. The handles with the bars are integral with the cup. The weight of a tree whose trunk is placed within the cup causes the legs of the holder to rotate about the handles generally toward each other and to the central area between them to hold the tree in place. Stops are provided along the rim of the cup to keep the legs from coming together so that the holder will not collapse when the tree is removed from the cup.

The Anderson U.S. Pat. No. 2,437,494 discloses a Christmas tree stand having three legs which extend through slots in enlarged portions of a rim of a cup for holding a tree. The enlarge rim portions extend outwardly from the rest of the rim and no ring is provided.

As will be described in greater detail hereinafter, the tree stand of the present invention is of a much simpler construction than the prior art tree stands. The weight of the tree itself transmits a force to upper sections of body legs of the tree stand, so as to force the trunk of the tree into an upright position and to maintain such position.

SUMMARY OF THE INVENTION

According to the invention there is provided a tree stand assembly of separable parts for holding a tree, such as a Christmas tree, in an upright position comprising:

a separate ring;

a separate container having an open top, a closed bottom, a diameter which is less than the diameter of said ring and arm means which are situated at the top of said container and which comprise at least two arms, each having means for releasably engaging said ring so that said container depends from said ring;

and a plurality of separate legs each of which has an upper section and means for releasably engaging and supporting said ring in such a manner that said upper section of each leg pivots inwardly about said ring against a trunk of a tree when a cut lower end edge of the trunk of the tree is placed within said container and creates a downward force on said ring by virtue of the weight of the tree upon said closed bottom of said container.

DESCRIPTION OF THE PREFERRED EMBODIMENT

Figure 1:
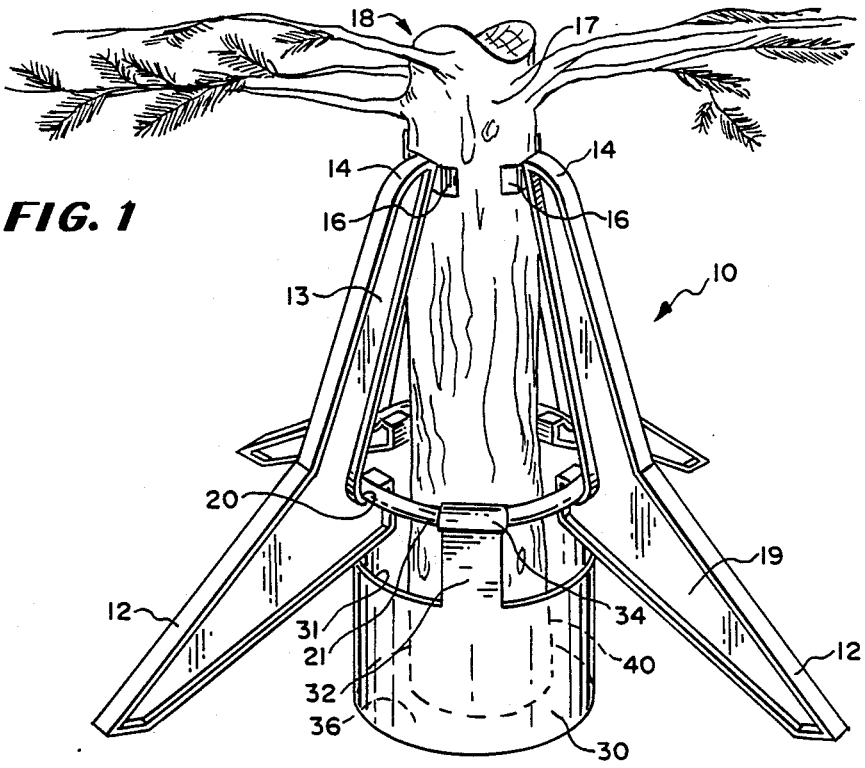
FIG. 1 is a perspective view of a tree stand constructed according to the teachings of the present invention and shows the stand being used to support a tree in an upright position.

Referring now to the drawings in greater detail, there is illustrated in FIG. 1 a perspective view of a tree stand 10 constructed according to the teachings of the present invention.

As illustrated, the tree stand 10 includes four identical legs 12 which each have the shape of a boomerang and include an upper, upwardly extending section 13. Each leg 12 has an upper end 14 having an inwardly facing concave clamp structure 16 which engages and applies pressure against a trunk 17 of a tree 18 received in and supported by the stand 10. Each leg 12 has a lower section 19 having a partially circular upwardly facing notch 20 at the upper inner end of each lower section 19. A ring 21 is received in each of the notches 20 for being supported by the legs 12. Each lower section 19 extends angularly outwardly and downwardly to a foot 22.

The ring 21 supports a cylindrical container 30 which has an upper open end 31 and which depends from the ring 21. For this purpose, the container 30 has four upwardly extending arms 32. Each arm 32 terminates at its upper end in a hook formation 34 which is received loosely or with a snap-fit over the ring 21. The container further has a closed bottom end 36.

As shown in phantom, a lower cut end 40 of the trunk 17 of the tree 18 is received within the container 30 and rests upon the closed bottom end 36 of the container 30, with the weight of the tree bearing down on the bottom end 36 of the container 30. The downward force of the weight of the tree 18 upon the bottom end 36 of the container 30 is transmitted by the hook formation 34 at the upper end of each arm 32 to the ring 21. The ring 21 then exerts a downward force on each lower section 19 of each leg 12, thereby urging the upper section 13 of each leg to pivot inwardly about each foot 22 to urge each clamp structure 16 at the upper end 14 of each leg 12 inwardly to bear against the trunk 17 of the tree 18 within the tree stand 10.

Figure 2:
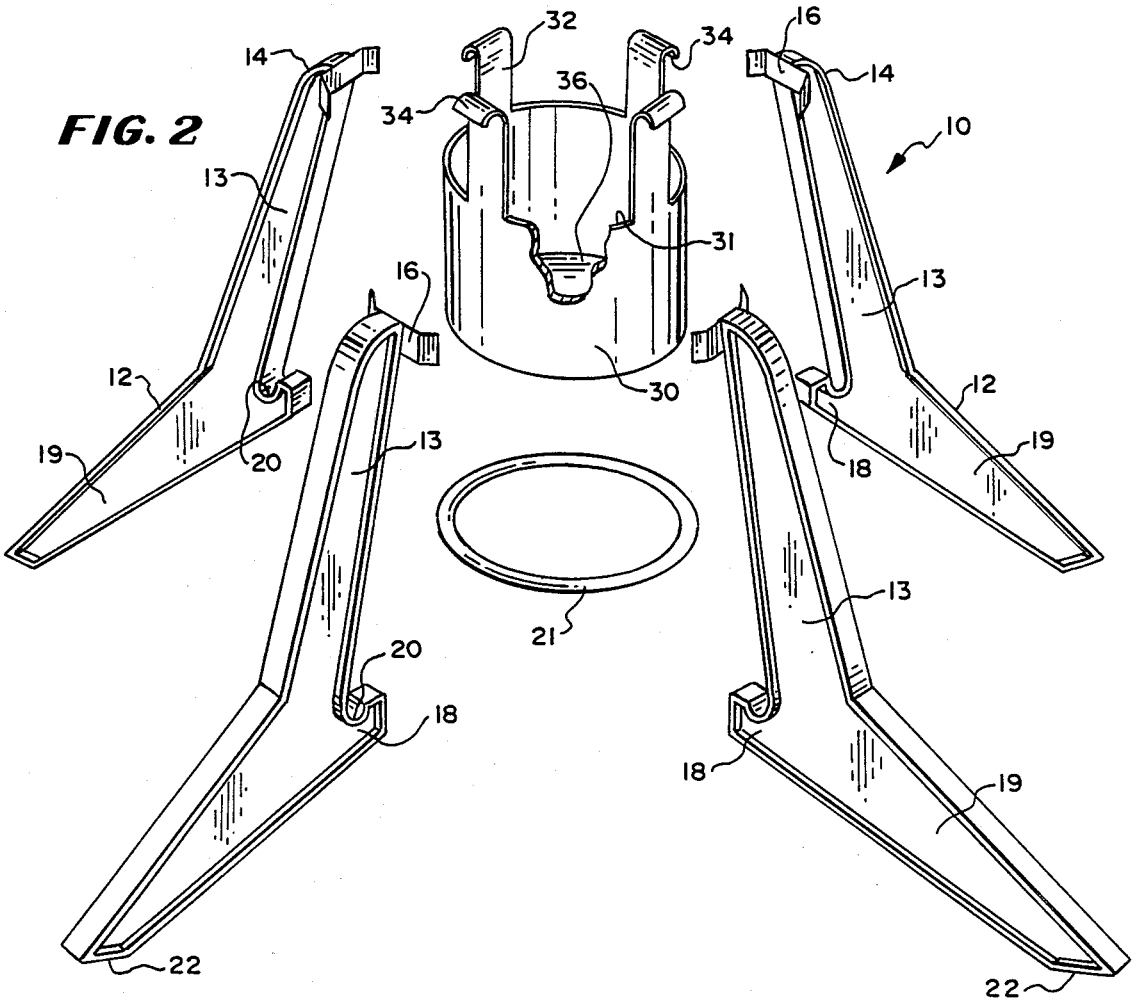
FIG. 2 is a perspective exploded view of the tree stand shown in FIG. 1.

Turning now to FIG. 2, there is illustrated therein an exploded view of the components of the tree stand 10 constructed according to the teachings of the present invention.

Although four legs 12 are shown in the preferred embodiment illustrated herein, the tree stand may be provided with only three legs 12.

Further, the ring 21 is an independent structure which has an inner diameter greater than the outer diameter of the container 30 so that the container 30 can be easily slipped through the ring 21 and hooked loosely or by a snap-fit of the radially outwardly facing hook formations 34 on the upper ends of the arms 32 extending upwardly from the open upper end 31 of the container 30 to the ring 21.

Also, as illustrated, each concave clamp structure 16, when viewed from a horizontal plane, has a generally C shaped configuration so as to apply pressure against the circumference of the tree trunk 17, without causing any damage to the integrity of the tree trunk 17.

Figure 3:
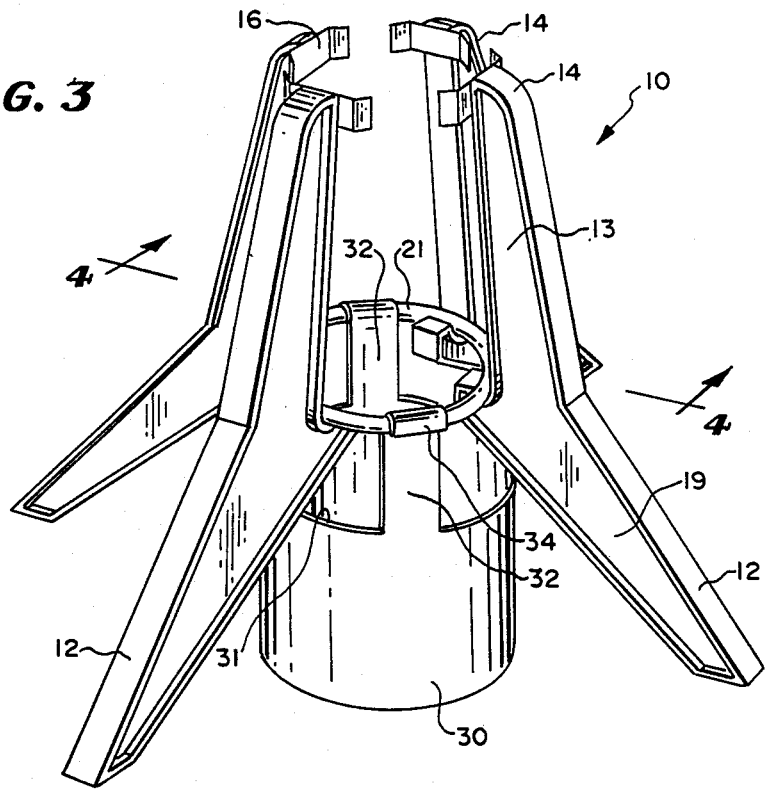
FIG. 3 is a perspective view of the tree stand shown in FIG. 1 without a tree trunk therein.

Turning now to FIG. 3 there is illustrated therein a perspective view similar to the view shown in FIG. 1 of the tree stand 10, but without having the tree 18 therein.

The stand 10 is here illustrated with the components thereof joined together so that a user need only spread the upper ends 24 of the legs apart and insert a cut end 40 of a tree trunk 17 within the container 30 of the stand 10. Here it is shown that the arms 32 of the container 30 having the hook formations 34 thereon are attached to the ring 21 in such a manner that the hook formations 34 are positioned equidistantly around the ring 21, each hook formation 34 being located between two adjacent legs 12 of the stand 10.

From this illustration, it will be appreciated that the number of arms 32 should be equal to the number of legs 12 utilized in the construction of the stand 10 so that the hook formations 34 are equidistantly spaced around the ring 20 between adjacent pairs of equidistantly spaced apart legs 12.

Figure 4:
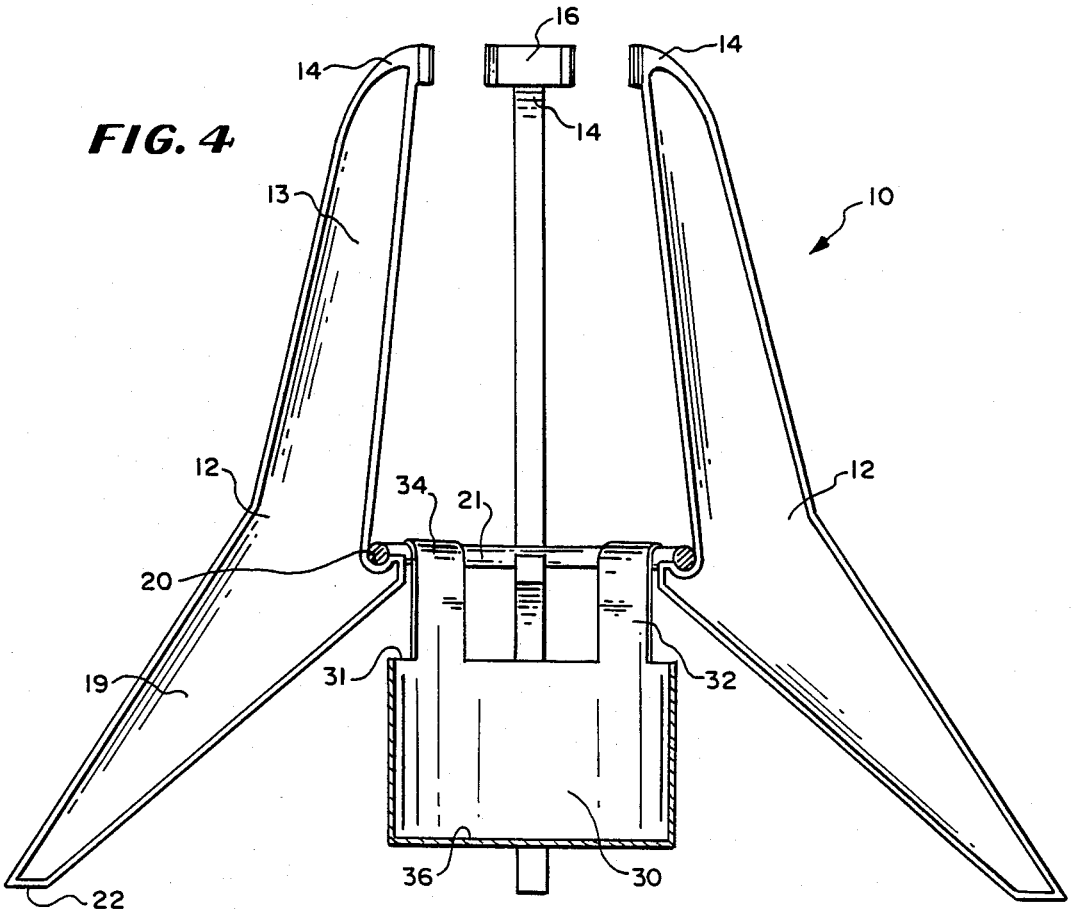
FIG. 4 is a vertical sectional view through the tree stand illustrated in FIG. 3 and is taken along line 4—4 of FIG. 3.

Turning now to FIG. 4, there is illustrated therein a sectional view through the tree stand 10. If desired, the dimensions of the ring 21 and the notches 20 can be such as to provide a snap-lock type fit therebetween. Also shown is the positioning of the hook formations 34 along the ring 21 between adjacent pairs of legs 12 of the stand 10.

It will be understood that various modifications can be made to the stand 10 of the present invention without departing from the teachings of the present invention. Accordingly, the scope of the invention is only to be limited as necessitated by the accompanying claims.

I claim:

1. A tree stand assembly of separable parts for holding a tree, such as a Christmas tree, in an upright position comprising:

a separate ring;

a separate container having an open top, a closed bottom, a diameter which is less than the diameter of said ring and arm means which are situated at the top of said container and which comprise at least two arms, each having means for releasably engaging said ring so that said container depends from said ring;

and a plurality of separate legs each of which has an upper section and means for releasably engaging and supporting said ring in such a manner that said upper section of each leg pivots inwardly about said ring against a trunk of a tree when a cut lower end edge of the trunk of the tree is placed within said container and creates a downward force on said ring by virtue of the weight of the tree upon said closed bottom of said container.

2. The tree stand assembly of claim 1 wherein said container is generally cylindrical in shape and has an open upper end and a closed bottom end.

3. The tree stand assembly of claim 1 wherein said arm means on said container for engaging said ring includes a plurality of upwardly extending arms spaced equidistantly around said open upper end thereof.

4. The tree stand assembly of claim 3 wherein each of said arms terminates at its upper end in a hook formation defining said engaging means which is received over said ring.

5. The tree stand assembly of claim 1 wherein each leg has the shape of a boomerang.

6. The tree stand assembly of claim 1 wherein each leg has an upper end and a clamp formation at said upper end.

7. The tree stand assembly of claim 1 wherein each leg has an . upwardly facing notch for receiving and supporting said ring.

8. The tree stand assembly of claim 3 wherein said container has at least three arms.

9. The tree stand assembly of claim 1 including at least three legs.

10. The tree stand assembly of claim 3 wherein the number of arms of said container is equal to the number of legs.

11. The tree stand assembly of claim 10 wherein each arm of said container is positioned between adjacent pairs of legs about the ring.

12. The tree stand assembly of claim 1 wherein said separate ring is an O ring.

13. A tree stand assembly for holding a tree, such as a Christmas tree, in an upright position comprising:

a ring;

a container having an open upper end and a closed bottom, a cross-section which is less than the diameter of said ring and a plurality of upwardly extending arms spaced equidistantly around said open upper end thereof with each arm terminating at its upper end in a hook formation which is received over and engages said ring so that said container depends from said ring;

and a plurality of legs each of which has an upper section and means for engaging and supporting said ring in such a manner that such upper section of each leg pivots inwardly about said ring against a trunk of a tree when a cut lower edge of the trunk of a tree is placed within said container and creates a downward force on said ring by virtue of the weight of the tree upon said closed bottom of said container.

14. The tree stand assembly of claim 13 wherein said ring is an O-ring.

* * * * *